United States Patent [19]

Theurer

[11] 4,135,332

[45] Jan. 23, 1979

[54] RAIL GRINDING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 708,017

[22] Filed: Jul. 23, 1976

[30] Foreign Application Priority Data

Dec. 1, 1975 [AT] Austria ..... 9133/75

[51] Int. Cl.[2] ..... B24B 23/00

[52] U.S. Cl. ..... 51/5 D; 51/178

[58] Field of Search ..... 51/178, 5 D

[56] References Cited

U.S. PATENT DOCUMENTS

| | | | |
|---|---|---|---|
| 3,738,066 | 6/1973 | Panetti | 51/178 |
| 3,945,152 | 3/1976 | Helgemeir | 51/178 |

FOREIGN PATENT DOCUMENTS

| | | | |
|---|---|---|---|
| 1014874 | 8/1957 | Fed. Rep. of Germany | 51/178 |
| 2255435 | 5/1974 | Fed. Rep. of Germany | 51/178 |

*Primary Examiner*—Harold D. Whitehead
*Assistant Examiner*—Roscoe V. Parker
*Attorney, Agent, or Firm*—Kurt Kelman

[57] ABSTRACT

A mobile rail grinding machine for grinding the running surface of the rails of a track comprises a grinding module mounted for power-driven vertical movement on a machine frame which runs on undercarriages on the track rails. The undercarriages have flanged wheels pressed without play against the track rails. The grinding module is associated with a respective track rail and is arranged laterally adjacent a respective side of the track rail. It includes a carrier frame, a grinding unit carrier mounted thereon adjustably positionable relative to the machine frame and the carrier frame, a grinding unit mounted on the grinding unit carrier, and a shaping tool for profiling the grinding surface of a rotatable grinding tool of the grinding unit which is arranged for continuously grinding one side of the track rail running surface as the machine frame and the grinding unit move in the operating direction.

30 Claims, 5 Drawing Figures

RAIL GRINDING MACHINE

The present invention relates to improvements in a mobile rail grinding machine for grinding away irregularities in the convex running surface of the rails of a track, more particularly the upper surface of the rail head which is contacted by the wheels of passing trains. Each track rail has a vertical plane of symmetry and respective sides of the running surface on each side of the plane of symmetry, and the rotatable rail grinding tools of the machine of this invention have a grinding surface arranged for continuously grinding one side of the track rail running surface. Rail grinding machines are known which comprise a machine frame, undercarriages mounting the machine frame for mobility on the track rails in an operating direction, the undercarriages having track rail engaging elements which are pressed without play against the track rails they engage, and a grinding module mounted for power-driven vertical movement on the machine frame, the grinding module being associated with a respective one of the track rails and mounting a grinding unit having a rotatable rail grinding tool with a grinding surface and a shaping tool for profiling the grinding surface of the grinding tool.

Modern-day high train speeds require the maintenance of a smooth running surface or tread of track rails for reasons of safety, economy and riding comfort. Because of the high loads to which the rails are subjected, they wear relatively rapidly and lose their intended profile, the running surface and the side edges of the rail heads developing faults, such as burrs, ripples and the like. This unevenness of the rail tread subjects the train wheels to vibrations and shocks, which not only causes discomfort to the passengers but also unfavorably influences the track alignment and greatly increases the noise level. Therefore, it is necessary to grind the rails from time to time to eliminate any accrued damage and smooth the running surfaces thereof. This has been done with the use of one or more rotating grinding discs which may be mounted either on light grinding machines, self-propelled machines or rail grinding trains.

German Published Patent Application (Offenlegungsschrift) No. 2,255,435 discloses a rail grinding machine with a series of grinding wheels for grinding the running surface of the rails of a track, which comprises a track or road going vehicle and a machine frame which is vertically movably supported on the vehicle. In its lowered position, the machine frame is guided without play on the track rails by means of sliding blocks and track rail engaging elements. The machine frame carries a vertically movable carrier with a grinding tool associated with each rail for grinding the entire running surface of the rail heads. Furthermore, a shaping tool for profiling the grinding surface of the grinding tool in conformity with the desired profile of the running surface is associated with each grinding tool, the shaping tool being vertically movable relative to the tool carrier. This arrangement does not make it possible to grind the running surfaces of the track rails accurately to their desired profiles since only a single grinding disc is provided per rail and the grinding discs are at a fixed distance transversely to the track. Thus, even minimal variations in the track gauge or inaccurate adjustments of the grinding tools in connection with the associated shaping tools will cause undesired excess grinding. Furthermore, very time-consuming adjustments are necessary and accurate grinding of both track rails simultaneously is not possible with this machine.

U.S. Patent No. 3,945,152 discloses a rail grinding machine wherein a grinding unit with a grinding wheel is mounted on a vertically movable carrier whose vertical position is determined by a rail sensing element. The guide elements for the carrier are mounted on a carrier frame which is pivotal about an axle mounted on the machine frame and extending parallel to the track. Grinding is effected by operating the grinding tool sequentially and in successive stages over the entire profile of the rail head. This is, of course, exceedingly time-consuming, particularly since it requires adjustments in connection with the rail sensing element at each operating stage and, in addition, fails to produce an accurate rail head profile since a series of adjacent grinding strips are produced which do not give a smooth surface. Furthermore, this machine, too, makes no allowance for variations in the track gauge without making time-consuming adjustments to achieve accurate grinding.

It is the primary object of the invention to provide a mobile rail grinding machine which enables the rail heads to be ground more accurately to a desired profile while reducing adjusting times for obtaining such profiles under varying operating conditions, such as differences in the track gauge, cant of adaptation to various rail profiles.

The above and other objects are accomplished in accordance with the present invention by the combination of a machine frame, undercarriages mounting the machine frame for mobility on the track rails in an operating direction, the undercarriages having track rail engaging elements, and mechanisms for pressing the track engaging elements without play against the train rails they engage, with a grinding module mounted for power-driven vertical movement on the machine frame, the grinding module being associated with a respective one of the track rails and being arranged laterally adjacent a respective side of the one track rail, each track rail having a vertical plane of symmetry and respective sides of the running surface on each side of the plane of symmetry. The grinding module includes a carrier frame, a grinding unit carrier mounted on the carrier, the grinding unit having a rotatable rail grinding tool with a grinding surface arranged for continuously grinding the running surface side of the one track rail as the machine frame and the grinding unit moves in the operating direction, and a shaping tool for profiling the grinding surface of the grinding tool.

In view of the multiple adjustability of the unit in conjunction with the shaping tool not only relative to the carrier frame but also relative to the machine frame, as well as the specific arrangement of the grinding tool in relation to the track rail, a high degree of universal adaptation of the grinding surfaces to the rails to be ground can be readily achieved under varying track gauge, track grade and rail head shape conditions. Even when the position of the rails relative to each other changes, high accuracy in grinding the rail heads to their desired profiles remains assured. The machine of this invention for the first time makes it possible to grind rail heads of different shapes accurately and speedily, mostly in a single grinding operation. The double adjustability of the grinding units makes it possible to maintain the adjustment of the grinding tools relative to the associated rails accurately even after the grinding tools have been lifted from contact with the rails. Furthermore, where the track gauge changes and/or there is a difference in the war of the respective rails, each grinding unit carrier and the grinding tool mounted thereon for grinding a respective running surface side of the rail head can be adjusted independently in its vertical position, particularly for adjustment to the surface curvature of the rails closer or farther from the machine frame. Thus, the machine operates with high accuracy and efficiency, in addition to being adaptable to varying operating conditions.

The above and other objects, advantages and features of the invention will become more apparent from the following detailed description of certain now preferred embodiments of a rail grinding machine for grinding the running surface of the rails of a track, taken in conjunction with the accompanying drawing wherein FIG. 1 is a side elevational view, partly in section along line I—I of FIG. 2, of a grinding module of the rail grinding machine associated with one track rail laterally adjacent a side of the rail;

Figure 3:
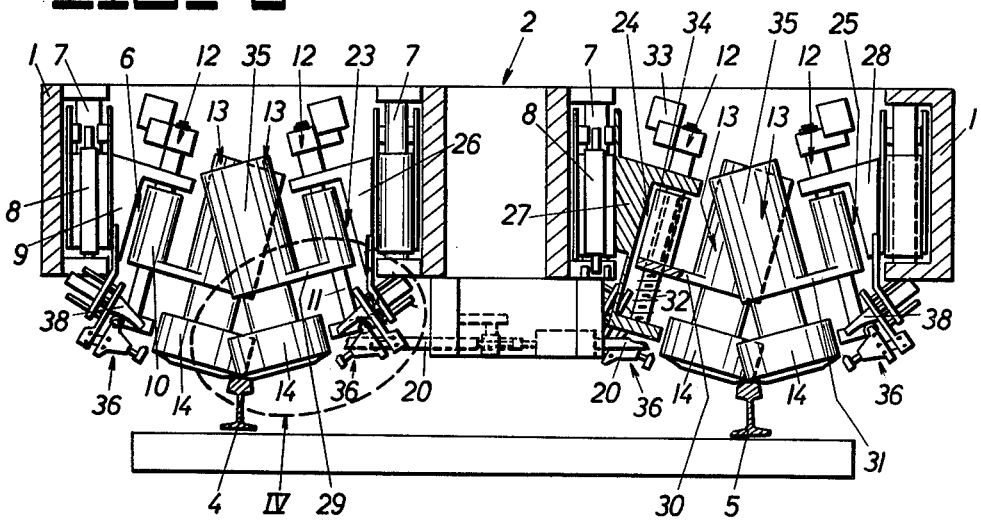
FIG. 3 is a section along line III—III of FIG. 2.
Figure 4:
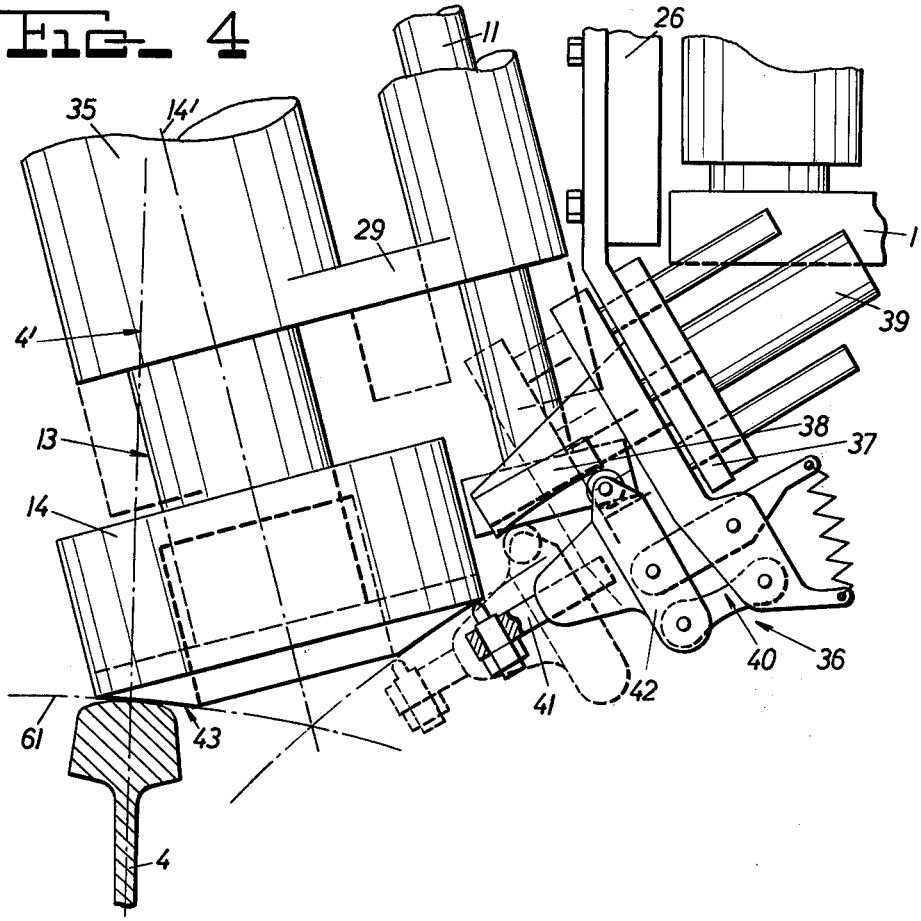
Figure 5:
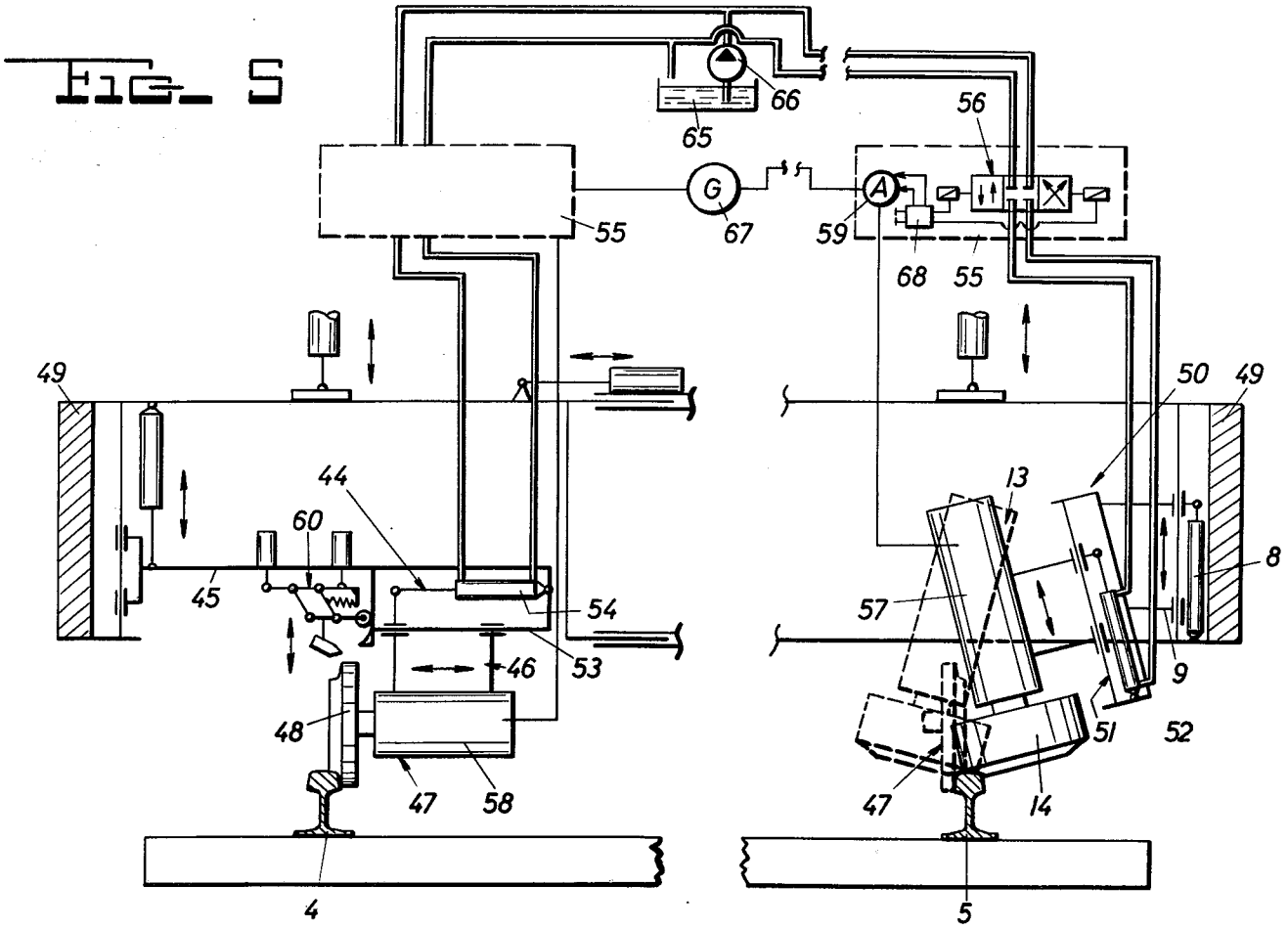

FIG. 4 is an enlarged end view of the grinding unit with the grinding tool and its cooperating shaping tool, as shown in the portion of the machine encircled by a broken line indicated by arrow IV in FIG. 3; and FIG. 5 is a schematic end view of another embodiment of the rail grinding machine, partially in section, the grinding modules respectively associated with rails 4 and 5 being staggered in the direction of the track, for grinding the running surfaces and the sides of the rail heads simultaneously and/or independently of each other.

Figure 1:
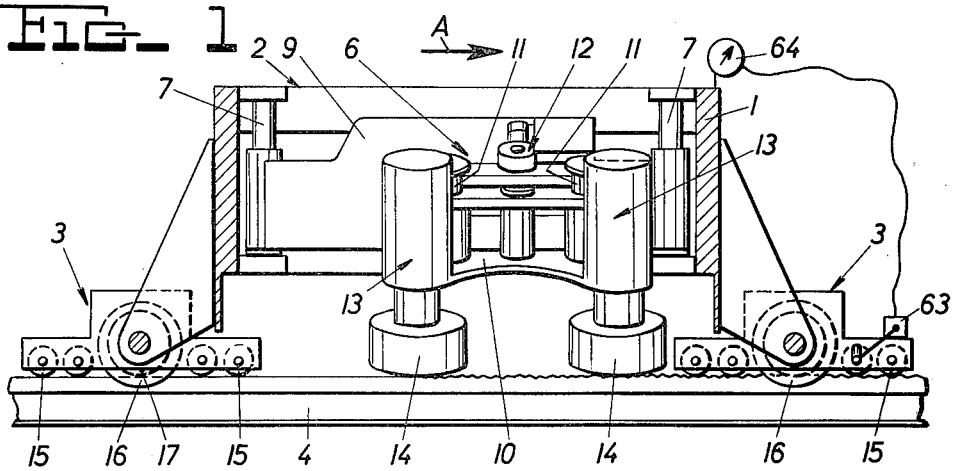
Figure 2:
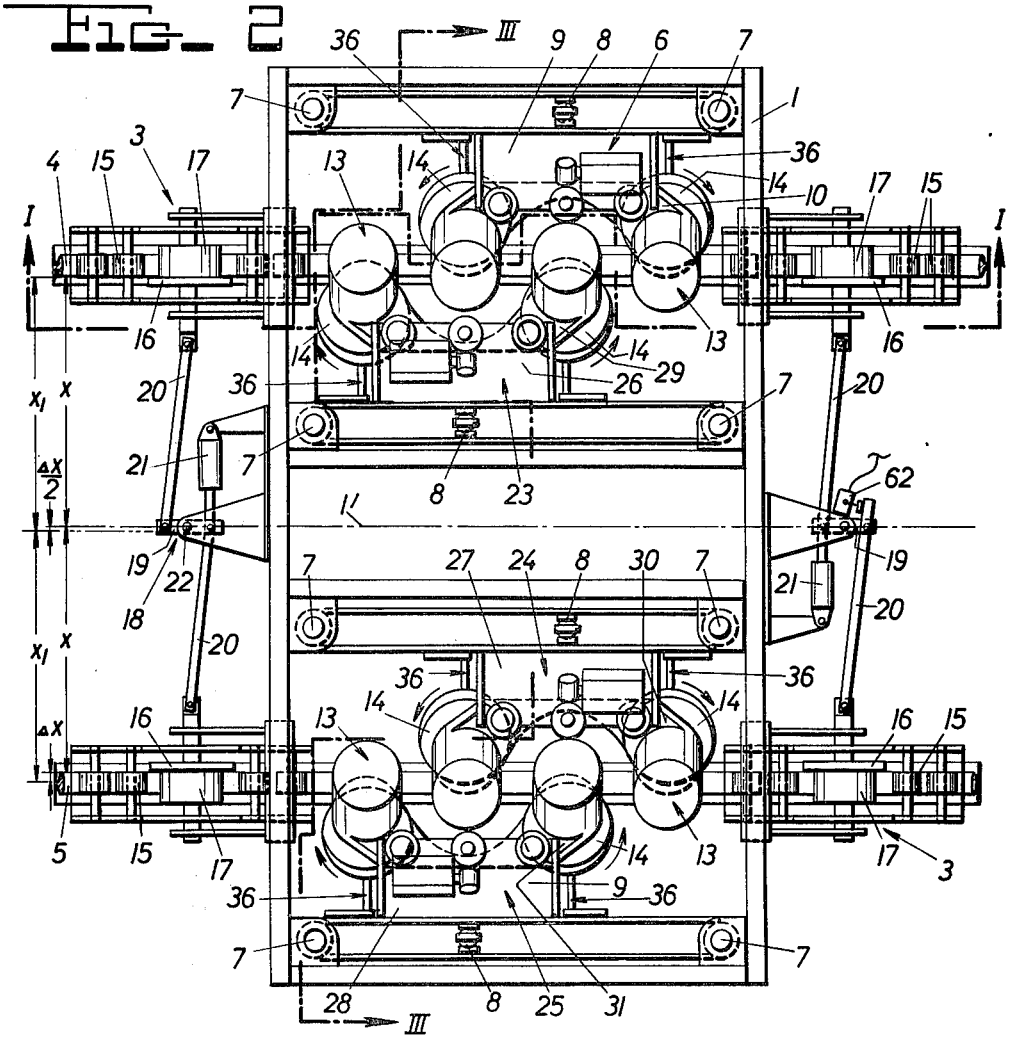
FIG. 2 is a top view of the machine with two such grinding modules associated with each rail.

Referring now to the drawing and first to FIGS. 1 and 2, there is shown machine frame 1 of mobile rail grinding machine 2. Undercarriages 3 mount the machine frame for mobility on track rails 4, 5 in an operating direction indicated by arrow A in FIG. 1. Grinding module 6 is mounted for power-driven vertical movement on machine frame 1. The grinding module includes carrier frame 9 which is mounted on a pair of vertical guide columns 7, 7 for vertical movement substantially perpendicularly to the track, a power drive 8 being connected to the carrier frame for moving the same along the guide columns which are supported on machine frame 1. Grinding unit carrier 10 is mounted on carrier frame 9 adjustably positionable relative to machine frame 1 and carrier frame 9. In the illustrated embodiment, this adjustable positioning is provided by mounting the carrier on a pair of guide columns 11, 11 which are supported on carrier frame 9 and drive 12 is provided for moving the tool carrier up and down along these guide columns. Two grinding units 13, 13 are mounted on carrier 10 spaced in the direction of track elongation, i.e. operating direction A. Each unit has rotatable rail grinding tool 14 with an annular grinding face 43 (see FIG. 4).

As shown in FIGS. 1 and 2, the grinding module is associated with a respective one of track rails 4, 5 and is arranged laterally adjacent a respective side of the one track rail, each track rail having a vertical plane of symmetry 4' (see FIG. 4) and respective sides of the running surface on each side of the plane of symmetry whereby the grinding surface of the grinding tool is arranged for continuously grinding the running surface side of the one track rail with which the carrier frame unit is associated as the machine frame and the tool unit moves in the operating direction A. The grinding unit can be lowered and raised with carrier 10 on which it is mounted.

It will be preferred to associate a respective one of grinding modules with each track rail and, in the illustrated embodiment, a pair of grinding modules 6, 23 and 24, 25 is associated with each track rail, grinding modules 6, 23 being arranged laterally adjacent each side of track rail 4 and grinding modules 24, 25 being arranged laterally adjacent each side of track rail 5 for grinding both sides of the running surfaces of both track rails.

For guiding machine frame 1 at a desired vertical spacing above the track, each undercarriage 3 has a series of rollers 15 aligned in the direction of the track rails and in rolling contact with the running surfaces of the rails, and the rail engaging element is a flanged wheel, each wheel 16 having flange 17, the flanged wheels being axially movable in relation to the machine frame so that the flanges may be pressed against the inside of the rail heads without play. The flanged wheels are mounted centrally between the rollers.

FIG. 2 shows a mechanism for pressing the flanged wheels without play against the track rails they engage, the illustrated mechanism 18 comprising linkage system 19, 20 arranged to spread transversely aligned pairs of the flanged wheels apart and to lock the spread flanged wheels in engagement with the track rails. As shown, mechanism 18 comprises two-armed lever 19 mounted on the machine frame centrally between track rails 4, 5 for pivoting about axis 22 perpendicular to the track, push rod 20 linked respectively to one of the arms of lever 19 and a respective one of the flanged wheels, and power drive 21. The illustrated drive is a hydraulic motor having one end linked to machine frame 1 and the other end to one arm of lever 19 for pivoting the lever. Operation of drive 21 to pivot layer 19 clockwise will press flanges 17 of wheels 16 without play against the rails 4 and 5 and will center center axis 1' of machine frame 1 between the track rails. As shown in broken lines, when rail 5 deviates by distance $\Delta x$ from the normal track gauge 2x, center axis 1' of machine frame 1 is moved by distance $\Delta x/2$ in the direction of rail 5 and is thus centered again, at distance $x_1$, between rails 4 and 5.

This arrangement for guiding machine frame 1 on the track rails has the advantage of minimizing frictional moments resisting the movement of the machine along the track, as compared, for instance, to sliding blocks. Furthermore, by centering the machine frame at all times and thus distributing one half of any deviation from the normal track gauge to each carrier frame unit associated with the respective rails, the extent of adjustment necessary for each unit is also halved, thus increasing the accuracy of the rail grinding and the efficiency of the operation.

As shown in FIGS. 2 and 3, grinding unit carriers 10, 29, 30, 31 of grinding modules 6, 23, 24, 25 and grinding units 13 mounted thereon are substantially identical. Modules 6, 23 associated with rail 4 and 24, 25 associated with rail 5, with their carrier frames 9, 26 and 27, 28 and carriers 10, 29, 30, 31 are arranged on machine frame 1 at a fixed distance from each other. Carriers 10, 29 and 30, 31 of the grinding modules associated with each rail are staggered in the direction of track elongation, as clearly shown in FIG. 2, the staggered relationship being such that the grinding unit carriers are spaced half the distance of that between the two grinding units 13, 13 mounted on each carrier so that the grinding tools 14 are interleaved for grinding successive portions of the rails. This provides a particularly efficient use of the grinding surfaces of the grinding tools and effective grinding of the running surfaces of the rails.

As shown in FIG. 2, and seen in operating direction A, front grinding unit 13 of rear carriers 29 and 31 is positioned between the two grinding units 13, 13 of the front carriers 10 and 30 respectively associated with rails 4 and 5. Similarly, rear unit 13 of front carriers 10, 30 is positioned between the two units 13, 13 of rear carriers 29, 31. This interleaving of the grinding units assures a short length of the machine frame and has considerable technological advantages in respect of the grinding since it avoids the creation of burrs, seams or other grinding faults between the ground halves of the running surfaces engaged by the opposing grinding tools. The direction of rotation of adjacent grinding tools 14 alternates, as shown by small arrows, so that sequentially arranged tools rotate in opposite directions, thus reducing the load on the grinding unit carriers and producing even grinding over the entire running surface. As shown, the carriers of the grinding modules associated with each rail are arranged mirror-symmetrically relative to the vertical plane of symmetry of the associated rail.

The illustrated arrangement provides a simple and efficient structure for grinding the entire running surface of both track rails simultaneously with cooperating grinding tools each grinding one half of the running surface. The grinding unit carriers are staggered so that successive grinding tools 14, which grind successive portions of opposite sides of the running surface of each rail, slightly overlap, which enables relatively large enveloping curvatures of the entire running surfaces to be continuously ground in a single operation or pass.

As will be explained with particular reference to FIG. 4, annular grinding faces 43 of disc-shaped grinding tools 14 are so profiled by shaping tools 41 associated therewith that the grinding zones overlap and burrs cannot develop. The mirror symmetry of the arrangement assures a particularly accurate and advantageous grinding operation producing a smooth running surface of high quality which provides a very smooth ride for the trains passing over the track.

As shown in FIGS. 3 and 4, the grinding tools of each grinding unit 13 are rotated by electric motor 35 and grinding surface profiling implement 36 is mounted on the grinding unit carrier for cooperation with each grinding tool, the profiling implement being vertically adjustable with the carrier. Each carrier is movable along guide columns 11 by power drive 12, the illustrated drive comprising threaded spindle 32 coaxial with the guide column and cooperating nut 34. The movement of the carriers along their guide columns adjusts the position of the grinding tools in relation to the rails during the grinding operation.

As illustrated, guide columns 11 for vertically movably mounting the grinding unit carriers on the carrier frames are arranged for moving the carriers in a plane obliquely inclined to the plane of symmetry 4' of the associated track rail. Axis of rotation 14' of the grinding tools extends parallel to the obliquely inclined axis of the guide columns 11 which are supported on the carrier frame, the axis of rotation extending in a plane which is perpendicular to the rail and to the track plane. In the illustrated embodiment, the angle between vertical plane of symmetry 4' and axis of rotation 14' is about 15°.

Pot-shaped grinding wheel 14 has a concave annular grinding surface 43, the center point of the circle forming the arcuate concavity of the grinding surface lying in vertical plane of symmetry 4'. The radius of this circle is so selected that the grinding surface will form an enveloping curve 61 for the running surface of the rail which will make grinding of the rail head possible even if it laterally deviates. For instance, the radius of the enveloping curve may be about 1600 mm for a curvature of the running surface of the rail of about 300 to 400 mm.

Electric motor 35 may be operated, for instance, with a power of about 7.5 kW to rotate grinding tool 14 at a speed of about 48 m/second. The abrasive material for the grinding tool may be resin-bonded corundum of medium granular size and having sufficient hardness for efficiently grinding steel rails.

The grinding surface of the grinding tool will be continuously profiled to maintain the desired concavity thereof, for which purpose shaping tool 41 is associated with each grinding tool. The shaping tool is arranged for profiling sequential portions of the annular grinding surface remote, i.e. diametrically opposite, from the portions of the grinding surface facing the track rail side during rotation of the grinding tool. As shown in FIG. 4, profiling implement 36 is movably mounted on carrier frame 26. Bracket 37 mounts the profiling implement on the carrier frame, the profiling implement comprising a replaceable patterning mechanism 38 and drive 39 for this mechanism. The patterning mechanism is slidable relative to bracket 37 on which it is supported and the drive consists of a cylinder-and-piston supported on the bracket. Shaping tool 41 is mounted on sensing element 42 which is pivoted on a guide part which is slidable by drive 39 perpendicularly and transversely to axis of rotation 14', i.e. radially relative to grinding tool 14. The guide part is guided in its movement by parallelogram guide mechanism 40 and sensing element 42 carries a cam follower roller cooperating with patterning mechanism 38 so that shaping tool 41 is movable on carrier frame 26, by and relative to, patterning mechanism 38 between the positions shown in full and broken lines in FIG. 4. The shaping tool carries a diamond grinding head for profiling the grinding surface of grinding tool 14.

The wear of the grinding surface is compensated by vertically adjusting grinding unit carrier 29 by operating drive 12. The position of the carrier at the time the grinding surface has been worn down is shown in FIG. 4 in broken lines.

The hereinabove described and illustrated adjustability of the grinding unit carrier makes the machine eminently adaptable to considerable variations in the track gauge during a continuous passage of the grinding machine over an extended track section for the continuous grinding of the track rails, the adjustment of the carrier position making it possible to continue accurate grinding as the track gauge changes, i.e. these changes in the track gauge can be readily compensated by a repositioning of the tool carriers. The oblique up and down guidance of the grinding unit carrier makes it possible to position the tool laterally as well as vertically in relation to the rail to be ground, thus taking into account different track gauges, i.e. laterally positions of the track rails, without changing the relationship of the grinding surface to the running surface of the rail. Thus, the properly shaped grinding surface always has the proper relation to the running surface for producing the desired profile of the rail head. Profiling of the grinding surface of the grinding tool even when badly worn and also during the grinding operation is greatly facilitated by making the carrier frame and the shaping tool vertically movable in unison relative to the machine frame, the illustrated embodiment providing for the vertical adjustability of the grinding unit carrier relative to the carrier frame and the profiling implement.

With the arrangement of the shaping tool diametrically opposite the grinding zone of an annular grinding surface of a grinding disc, the grinding surface may be profiled to match the running surface of the rail to be ground without affecting the contact pressure of the grinding tool.

The patterned movement of the shaping tool in a radial direction relative to the grinding tool makes it possible to profile the grinding surface of the tool without excessive wear and also facilitates conforming the grinding surface to different rail head configurations. Furthermore, the radial guidance of the shaping tool assures a very high accuracy in the profiling of the grinding surface, thus further increasing the accuracy of the grinding operation.

The pot-shaped grinding disc has an annular concave grinding surface whose enveloping curvature conforms to the curvature of one side of the running surface of the track rail, the profile of the curvature being such that it encompasses different zones of the running surface of the track rail with respect to differences in the track gauge, with a constant angular position of the axis of rotation of the grinding tool and transverse repositioning thereof by movement along oblique column 11.

The guidance of the grinding unit carrier along fixed guide columns and by means of a threaded spindle-and-nut drive makes an accurate adjustment of the tool position possible, hydraulic motor drive 12 for rotating the spindle enabling rapid adjustments to be executed and avodiance of vibrations.

FIG. 5 schematically illustrates another embodiment of a rail grinding machine according to the present invention, like reference numerals designating like parts functioning in a like manner in this embodiment to avoid redundancy in the description. In this embodiment, grinding module 44 is shown associated with track rail 4, this module, as the grinding modules of the first described embodiment, also including a carrier frame 45 and a grinding unit carrier 46, a grinding unit 47 being mounted on the carrier. The grinding unit of this module, however, has a rotatable rail grinding tool 48 with a grinding surface arranged for continuously grinding the inside of the rail head including the upper edge of the rail head adjacent thereto and joining the inside to the running surface of the rail head. As in the first-described embodiment, carrier frame 45 is vertically movably mounted on machine frame 49 which runs on the track. Guide columns 53 extending generally parallel to the track plane and transversely to the track mount grinding unit carrier 46 for transverse movement in relation to rail 4 so that grinding wheel 48 may be moved into and out of grinding contact with the rail head. The grinding tool is rotated about a horizontal axis by electric motor 58 and hydraulic drive 54 moves the grinding unit carrier along columns 53.

Machine frame 49 supports grinding module 50 in association with the other track rail 5. This grinding module is staggered relative to grinding module 44 in the direction of the track elongation so that grinding unit 14 of module 50 will be forwardly spaced from grinding unit 47 of module 44. Grinding module 50 is of the generally same structure as modules 6, 23, 24, 25 of the first-described embodiment, its grinding unit carrier being vertically movable along obliquely positioned guide columns 51 by hydraulic drives 52 while electric motor 57 rotates grinding tool 14 arranged to grind one half of the running surface of rail 5.

As shown, both types of grinding modules are mounted on a single machine frame so that they constitute a mobile unit enabling the entire rail head of both rails to be ground along its running surface as well as the inside thereof as the unit advances along the track, a module 50 followed by a module 44 being associated with each rail.

In this embodiment, machine frame 49 is a two-part structure divided along a center line extending between the two track rails, the two machine frame parts being interconnected by telescoping guide elements extending transversely to the track to permit the two parts to be moved together and apart in a transverse direction. Drive means is provided to spread the two machine frame parts apart so that flanged wheels fixedly mounted on each machine frame part are pressed into play-free engagement with the track rails. For the sake of clarity, the flanged wheels, which are mounted at a fixed distance from the grinding modules, are not shown in the drawing. Pressing each machine frame part into tight engagement with the rail with which it is associated assures centering of the grinding modules and their grinding tools in relation to the associated rails regardless of the track gauge.

Hydraulic motors 52 and 54, which position the grinding unit carriers with respect to the associated rails and thus properly adjust the position of the grinding tools, are each operated by control 55 which includes servo-valve 56 mounted in the hydraulic circuit connected between hydraulic fluid sump 65 and the respective hydraulic motor, pump 66 delivering the hydraulic fluid to the motors, as controlled by servo-valve 56. The servo-valves are electrically operated by connection to a voltage source illustrated as generator 67 which is also connected to electric motors 57, 58 for rotating the grinding tools. The solenoids of the servo-valves are connected to the electric control circuit leading from generator 67 to the electric motors by a threshold switch 68.

The rail grinding machine schematically shown in FIG. 5 operates in the following manner:

Machine frame 49 for the grinding modules may be mounted for vertical movement on a self-propelled vehicle running on the track, and when the vehicle arrives at the working site, the machine frame is lowered until its flanged wheels are on a level with the track and the two machine frame parts are then pressed apart until the flanged wheels of the machine frame engage trail rails 4, 5 without play. The grinding machine is now in operating condition and the carrier frames 9 and 45 of grinding modules 50 and 44 are lowered until grinding tools 14 and 48 are positioned slightly above and out of contact with their associated rail heads.

Threshold switch 68 is set to determine the limits of current delivery to electric motors 57 and 58 so as to provide a minimum and a maximum motor operating current, which is indicated at current indicating instrument 59, this adjustable setting determining the grinding or abrading depth obtained by the rotating grinding tools. Since generator 67 is connected not only to the electric grinding tool motors but also the solenoids of valves 56, the resultant operation of the valves also controls hydraulic fluid flow to the hydraulic motors which adjust the distance between the grinding tools and the associated rails. This adjustment is terminated and the grinding tools move no closer to the associated rails as soon as the set current delivery to electric motors 57 and 58, which is determined by the current required for a certain abrading depth, has been reached. As this adjustment proceeds and after it has been terminated, machine frame 49 continuously advances along the track. As the surface characteristics of the rail surfaces change, the grinding tools will be automatically moved towards the associated rail heads when the electric motors 57 and 58 receive too little current, i.e. the abrading depth is not deep enough, while they will be moved away when too much current is received by the motors rotating the grinding tools. This assures substantially the same set abrading depth to be maintaned as the machine passes along the track continuously so that a smooth surface will be obtained. To maintain the desired grinding surface profiles during the entire operation, shaping tools are associated with the grinding tools, profiling implement 60, which is guided in a similar manner as implement 36, being associated with grinding tool 48.

The grinding surfaces of the grinding tools are preformed to conform to the desired enveloping curves of the rail head surfaces to be ground and their profiles are maintained during the grinding operation by the shaping tools associated with the grinding tools. While the profiling motion of the profiling implements 36, 60 has been described and illustrated in connection with a patterning mechanism and a parallelogram guide driven by a hydraulic motor, the slow radial movement of the shaping tool with respect to the grinding surface could be effected manually or by a time-relay control, for example.

With an exact track gauge of 1,435 mm, i.e. a distance between planes of symmetry 4' of the two track rails of 1500 mm, the grinding zones of opposing grinding tools 14, 14 associated with respective running surface sides of the same rail will preferably overlap by about 15 mm (see FIG. 2). Thus, even if the track gauge is increased by 30 mm, the running surfaces will still be ground effectively.

In case of extreme track gauge increments in track curves, axes of rotation 14' of the grinding wheels may be repositioned vertically as well as laterally relative to the associated rails by the combined vertical adjustment of carrier frames 9, 26, 27, 28 by hydraulic drives 8 and the vertical-lateral adjustment of grinding unit carriers 10, 29, 30, 31 by spindle drives 12 so that enveloping curve 61 (see FIG. 4) is centered over the rail head center.

Centering is facilitated by mounting gauge 62 in the range of two-armed lever 19 of the spreading mechanism (see FIG. 2) for indicating changes in the track gauge and using the gauge as a control for the adjustment and repositioning of the grinding tools. Since center axis 1' is always centered by spreading mechanism 18, only half of each track gauge change is felt at each rail, thus reducing necessary adjustments to half the amount required by the change in track gauge.

The machine frame serves as a reference for the grinding of the rails and since the undercarriages of the machine frame have five sequentially arranged rail engaging elements 15, 16, the machine frame will always rest in the range of its undercarriages on a raised, rather than a recessed portion of the rail if the rails have only short serrations whereby a smooth and even ground running surface is assured. If the running surfaces of the rails have elongated corrugations, it may be useful to arrange more than five rail engaging rollers on the undercarriages. It is also possible to mount a rail surface sensing element in the range of the grinding tools. As shown in FIG. 1, one of the rollers 15 may be close enough to a grinding tool to constitute such a rail surface sensing element. Such sensing elements will indicate any vertical deviation of the rail running surface from the machine frame which forms the reference for the grinding or a special reference system provided for this purpose. A gauge 63 may be associated with the sensing element to indicate any surface deviations and the gauge may be connected, as shown in FIG. 1, to an indicating instrument 64. Such rail surface sensing in connection with a reference will increase the accuracy of the grinding operation and hold grinding to a minimum required to obtain a smooth surface.

What is claimed is:

1. A mobile rail grinding machine for grinding the running surface of the rails of a track, each track rail having a vertical plane of symmetry and respective sides of the running surface on each side of the plane of symmetry, comprising (1) a machine frame;

(2) undercarriages mounting the machine frame for mobility on the track rails in an operating direction, the undercarriages having (a) track rail engaging elements;

(3) mechanisms for pressing the track engaging elements without play against the track rails they engage; and (4) a grinding module mounted for power-driven vertical movement on the machine frame, the module being associated with a respective one of the track rails and being arranged laterally adjacent a respective side of the one track rail, the grinding module including (a) a carrier frame, (b) a grinding unit carrier mounted on the carrier frame adjustably positionable relative to the machine frame and the carrier frame, (c) a grinding unit mounted on the carrier, the grinding unit having a rotatable rail grinding tool with a grinding surface arranged for continuously grinding the side of the running surface of the one track rail as the machine frame and the grinding unit moves in the operating direction, and (d) a shaping tool for profiling the grinding surface of the grinding tool.

2. The mobile rail grinding machine of claim 1, wherein a pair of said grinding modules is associated with each of the track rails, a respective one of the modules of each pair being arranged laterally adjacent opposite sides of the track rails for grinding both sides of the running surfaces of the track rails.

3. The mobile rail grinding machine of claim 1, further comprising guide columns for vertically movably mounting the grinding unit carrier on the carrier frame, the guide columns being arranged for moving the carrier in a plane obliquely inclined to the plane of symmetry of the associated track rail laterally towards and away from the rail.

4. The mobile rail grinding machine of claim 3, wherein the grinding surface of the grinding tool is arranged between the vertical plane of symmetry and the axis of rotation of the grinding tool, said axis extending parallel to the obliquely inclined plane.

5. The mobile rail grinding machine of claim 1, further comprising guide columns for laterally movably mounting the grinding unit carrier on the carrier frame for movement in a plane substantially parallel to the track and transversely thereof.

6. The mobile rail grinding machine of claim 2, wherein the grinding unit carriers of the modules are arranged mirror-symmetrically relative to the vertical plane of symmetry of the one track rail.

7. The mobile rail grinding machine of claim 6, wherein the modules associated with one track rail are arranged at a fixed distance from the modules associated with the other track rail.

8. The mobile rail grinding machine of claim 6, wherein the mirror-symmetrically arranged grinding unit carriers of the grinding modules are staggered in the direction of track elongation.

9. The mobile rail grinding machine of claim 1, wherein two of said grinding units are mounted on the carrier spaced in the direction of track elongation.

10. The mobile rail grinding machine of claim 9, the axes of rotation of the rail grinding tools extending in the same plane, the plane being obliquely inclined relative to the plane of symmetry of the associated track rail.

11. The mobile rail grinding machine of claim 9, wherein a pair of said grinding modules is associated with each of the track rails, a respective one of the modules of each pair being arranged laterally adjacent opposite sides of the track rails for grinding both sides of the running surfaces of the track rails, one of the grinding units of one of grinding modules being arranged between the two grinding units of the other grinding module of each pair.

12. The mobile rail grinding machine of claim 1, wherein the carrier frame and the shaping tool are vertically adjustable in unison relative to the machine frame.

13. The mobile rail grinding machine of claim 12, wherein the grinding unit carrier is adjustable relative to the carrier frame and the shaping tool.

14. The mobile rail grinding machine of claim 1, wherein the rotatable grinding tool is disc-shaped and has a concave grinding surface, the grinding tool being arranged in the grinding unit with sequential portions of the concave grinding surface facing the side of the one track rail during rotation of the tool and continuous grinding of the track rail side.

15. The mobile rail grinding machine of claim 14, wherein the shaping tool is arranged for profiling sequential portions of the grinding surface remote from the portions of the grinding surface facing the track rail side during the rotation of the grinding tool.

16. The mobile rail grinding machine of claim 1, wherein the carrier frame and the shaping tool are vertically adjustable in unison relative to the machine frame, the shaping tool being mounted movably on the carrier frame, and further comprising a patterning mechanism cooperating with the shaping tool, the shaping tool being movable on the carrier frame by, and relative to, the patterning mechanism and radially in relation to the axis of rotation of the grinding tool.

17. The mobile rail grinding machine of claim 16, further comprising a parallelogram guide mechanism for guiding the movement of the shaping tool.

18. The mobile rail grinding machine of claim 1, wherein the rotatable grinding tool is disc-shaped and has an annular concave grinding surface, the curvature of the grinding surface conforming to that of the side of the running surface of the one track rail, the profile of the curvature being such that it encompasses different zones of the running surface of the track rail with respect to differences in the track gage, with a constant angular position of the axis of rotation of the grinding tool and transverse repositioning thereof.

19. The mobile rail grinding machine of claim 1, further comprising a pair of guide columns for vertically movably mounting the grinding unit carrier on the carrier frame and a power driver for moving the carrier on the guide columns.

20. The mobile rail grinding machine of claim 19, wherein the power drive comprises a threaded spindle and a hydraulic motor for rotating the spindle.

21. The mobile rail grinding machine of claim 19, wherein two of said grinding units are mounted on the carrier and the power drive is centered between the guide columns and the grinding units.

22. The mobile rail grinding machine of claim 1, wherein the undercarriages have a series of rollers aligned in the direction of the track rails and the track rail engaging elements are flanged wheels mounted intermediate the rollers, and the mechanisms for pressing the track rail engaging elements without play against the track rails comprise a linkage system arranged to spread transversely aligned pairs of the flanged wheels apart and to lock the spread flanged wheels in engagement with the track rails.

23. The mobile rail grinding machine of claim 22, wherein the mechanisms comprise a two-armed lever mounted on the machine frame centrally between the track rails for pivoting about an axis perpendicular to the track, a push rod linked respectively to one of the lever arms and a respective one of the flanged wheels, and a power drive linked to the lever for pivoting the same.

24. The mobile rail grinding machine of claim 1, further comprising an additional grinding module mounted on the machine frame spaced from the first-named grinding module in the direction of track elongation whereby the grinding modules constitutes a single mobile unit, the additional grinding module carrying a rotatable rail grinding tool with a grinding surface arranged for continuously grinding the inner side of the rail head of the one track rail as the machine frame and the grinding tool on the additional grinding module moves in the operating direction.

25. The mobile rail grinding machine of claim 24, wherein the additional grinding module is mounted for power-driven vertical movement on the machine frame, the additional module being associated with the one track rail and including a carrier frame, a grinding unit carrier mounted on the carrier frame adjustably positionable relative to the machine frame and the carrier frame, a grinding unit mounted on the carrier, the grinding unit having the last-named rotatable rail grinding tool, and a shaping tool for profiling the grinding surface of the last-named grinding tool.

26. Rail grinding apparatus mounted on a machine frame of a mobile rail grinding machine for grinding the running surface of a track rail having a vertical plane of symmetry and respective sides of the running surface on each side of the plane of symmetry, the grinding apparatus comprising (a) a pair of grinding modules associated with the rail, a respective one of the modules being arranged laterally adjacent opposite sides of the rail for grinding both sides of the running surface of the rail, and the modules being spaced from each other along the rail, each grinding module including (1) a carrier frame mounted for power-driven vertical movement on the machine frame, (2) a grinding unit carrier mounted on the carrier frame adjustably positionable relative to the machine frame and the carrier frame, (3) a grinding unit mounted on the carrier, the grinding unit having a rotatable rail grinding tool with a concave annular grinding surface arranged for continuously grinding the laterally adjacent side of the running surface of the track rail as the grinding unit moves along the track rail, the curvature of the grinding surface conforming to that of the laterally adjacent side of the running surface whereby the grinding surfaces of the tools of the pair of grinding modules together grind the running surface of the track rail, and (4) a shaping tool for profiling the grinding surface of the grinding tool for continuously conforming the curvature of the grinding surface to that of the laterally adjacent running surface side.

27. The rail grinding apparatus of claim 26, further comprising guide means for vertically movably mounting the grinding unit carrier on the carrier frame, the guide means being arranged for moving the carrier in a plane obliquely inclined to the plane of symmetry of the track rail laterally towards and away from the rail.

28. The rail grinding apparatus of claim 27, wherein the grinding surface of the grinding tool is arranged between the vertical plane of symmetry and the axis of rotation of the grinding tool, said axis extending parallel to the obliquely inclined plane.

29. Rail grinding apparatus mounted on a machine frame of a mobile rail grinding machine for grinding the running surface of a track rail having a vertical plane of symmetry and respective sides of the running surface on each side of the plane of symmetry, the grinding apparatus comprising (*a*) a pair of grinding modules associated with the rail, a respective one of the modules being arranged laterally adjacent opposite sides of the rail for grinding both sides of the running surface of the rail, and the modules being spaced from each other along the rail, each grinding module including (1) a carrier frame mounted for power-driven vertical movement on the machine frame, (2) a grinding unit carrier, (3) guide means for vertically movably mounting the grinding unit carrier on the carrier frame, the guide means being arranged for moving the carrier in a plane obliquely to the plane of symmetry of the track rail laterally towards and away from the rail, (4) a grinding unit mounted on the carrier, the grinding unit having a rotatable rail grinding tool with a grinding surface arranged for continuously grinding the laterally adjacent side of the running surface of the track rail as the grinding unit moves along the rail, and (5) a shaping tool for profiling the grinding surface of the grinding tool.

30. The rail grinding apparatus of claim 29, wherein the grinding tool surface is a concave annular surface having a curvature conforming to that of the laterally adjacent running surface side whereby the grinding surfaces of the tools of the pair of grinding modules together grind the running surface of the track rail, and the shaping tool is arranged for continuously conforming the curvature of the grinding surface to that of the laterally adjacent running surface side.

* * * * *